US011839001B2

(12) United States Patent
Merck et al.

(10) Patent No.: US 11,839,001 B2
(45) Date of Patent: Dec. 5, 2023

(54) CEILING FAN HAVING AN ELECTRIC LAMP WHICH HAS CONTINUOUS COLOR TEMPERATURE CONTROL

(71) Applicant: OLIBRA LLC, Cresskill, NJ (US)

(72) Inventors: Christopher Andrew Merck, Vernon, NJ (US); Zohar Shinar, Demarest, NJ (US)

(73) Assignee: OLIBRA LLC, Cresskill, NJ (US)

( * ) Notice: Subject to any disclaimer, the term of this patent is extended or adjusted under 35 U.S.C. 154(b) by 0 days.

(21) Appl. No.: 17/845,229

(22) Filed: Jun. 21, 2022

(65) Prior Publication Data

US 2022/0418065 A1 Dec. 29, 2022

Related U.S. Application Data

(60) Provisional application No. 63/212,733, filed on Jun. 21, 2021.

(51) Int. Cl.

| | |
|---|---|
| ***H05B 45/20*** | (2020.01) |
| ***H05B 47/19*** | (2020.01) |
| ***H05B 47/115*** | (2020.01) |
| ***F21V 33/00*** | (2006.01) |

(52) U.S. Cl.

CPC ..... *H05B 45/20* (2020.01); *F21V 33/0096* (2013.01); *H05B 47/115* (2020.01); *H05B 47/19* (2020.01)

(58) Field of Classification Search

CPC ..... H05B 45/20; H05B 47/10; H05B 47/11; H05B 47/115; H05B 47/105; H05B 47/19; H05B 47/195; F21V 33/0096; F21V 29/74; F21V 23/0435; F04D 25/088; F04D 25/0613; A61L 9/032; A61L 9/18; A61L 9/20; Y02B 20/30; Y02B 30/70; F21Y 2115/10

See application file for complete search history.

(56) References Cited

U.S. PATENT DOCUMENTS

| | | | | |
|---|---|---|---|---|
| 9,217,542 | B2 * | 12/2015 | Pickard | F21K 9/232 |
| 10,030,863 | B2 * | 7/2018 | Pickard | F21V 29/74 |
| 10,674,579 | B2 * | 6/2020 | Bruckner | H05B 45/397 |
| 11,063,585 | B2 * | 7/2021 | Chen | H05B 47/13 |

(Continued)

*Primary Examiner* — Haissa Philogene

(74) *Attorney, Agent, or Firm* — Browdy and Neimark, PLLC

(57) ABSTRACT

Ceiling fan having an electric lamp which has continuous color temperature control. A ceiling fan includes an electric motor which rotates blades; and an electric lamp, which is an integrated component of the ceiling fan and is co-located beneath the blades. The motor and the lamp receive electric power from a mains electric socket via a single electric power cord that provides Alternating Current. The lamp is configured to emit visible light having light warmth at a user-configurable level along a continuous spectrum of light warmth, between a lower-bound value and an upper-bound value. The electric lamp includes a first set of LEDs and a second set of LEDs. The first set of LEDs is capable of emitting visible light at a first, fixed, light warmth value, which is the lower-bound value of that continuous spectrum of light warmth levels. The second set of LEDs is capable of emitting visible light at a second, fixed, light warmth value, which is the upper-bound value of that continuous spectrum of light warmth levels.

16 Claims, 8 Drawing Sheets

(56) References Cited

U.S. PATENT DOCUMENTS

| | | | | |
|---|---|---|---|---|
| 11,305,031 | B2 * | 4/2022 | Sood | A61L 9/22 |
| 2009/0035177 | A1 * | 2/2009 | McEllen | A61L 9/18 422/4 |
| 2009/0162197 | A1 * | 6/2009 | Klemo | F04D 29/662 416/1 |
| 2009/0207604 | A1 * | 8/2009 | Robotham | F21S 10/02 362/230 |
| 2012/0045331 | A1 * | 2/2012 | Villella | F04D 29/36 416/5 |
| 2015/0235552 | A1 * | 8/2015 | Cai | H04B 3/54 340/12.32 |
| 2019/0229536 | A1 * | 7/2019 | Wang | F04D 27/004 |
| 2021/0270290 | A1 * | 9/2021 | Santolucito | F04D 29/36 |

* cited by examiner

CEILING FAN HAVING AN ELECTRIC LAMP WHICH HAS CONTINUOUS COLOR TEMPERATURE CONTROL

CROSS-REFERENCE TO RELATED APPLICATIONS

This patent application claims benefit and priority from U.S. 63/212,733, filed on Jun. 21, 2021, which is hereby incorporated by reference in its entirety.

FIELD

Some embodiments relate to the field of ceiling fans and electric lamps.

BACKGROUND

A ceiling fan is a fan that is mounted on the ceiling of a room or space. A ceiling fan is typically electrically powered, and it uses hub-mounted rotating blades to circulate air. An electric motor rotates the blades of the ceiling fan. Ceiling fans may be used to move air or to circulate air, thereby increasing satisfaction or convenience of occupants of a house or building.

A light fixture, also known as a light fitting or a luminaire, is an electrical device having an electric lamp that provides illumination. For example, the electric lamp receives electric power and converts it to visible light. Billions of light fixtures and electric lamps are used worldwide, to provide interior lighting in homes and buildings, to provide exterior light for nighttime activities, or the like.

SUMMARY

Some embodiments provide a ceiling fan with an electric lamp that has continuous color temperature control; for example, enabling the end-user to modify the warmth (or coolness) level of the overall light that is emitted, to virtually any value (in Kelvin) on a range or a continuum or spectrum; for example, any value in the range of 1.250 Kelvin to 9.900 Kelvin.

For example, a ceiling fan includes an electric motor which rotates blades; and an electric lamp, which is an integrated component of the ceiling fan and is co-located beneath the blades. The motor and the lamp receive electric power from a mains electric socket via a single electric power cord that provides Alternating Current. The lamp is configured to emit visible light having light warmth at a user-configurable level along a continuous spectrum of light warmth, between a lower-bound value and an upper-bound value. The electric lamp includes a first set of LEDs and a second set of LEDs. The first set of LEDs is capable of emitting visible light at a first, fixed, light warmth value, which is the lower-bound value of that continuous spectrum of light warmth levels. The second set of LEDs is capable of emitting visible light at a second, fixed, light warmth value, which is the upper-bound value of that continuous spectrum of light warmth levels.

Some embodiments may provide other and/or additional benefits and/or advantages.

DETAILED DESCRIPTION OF SOME DEMONSTRATIVE EMBODIMENTS

Figure 1:
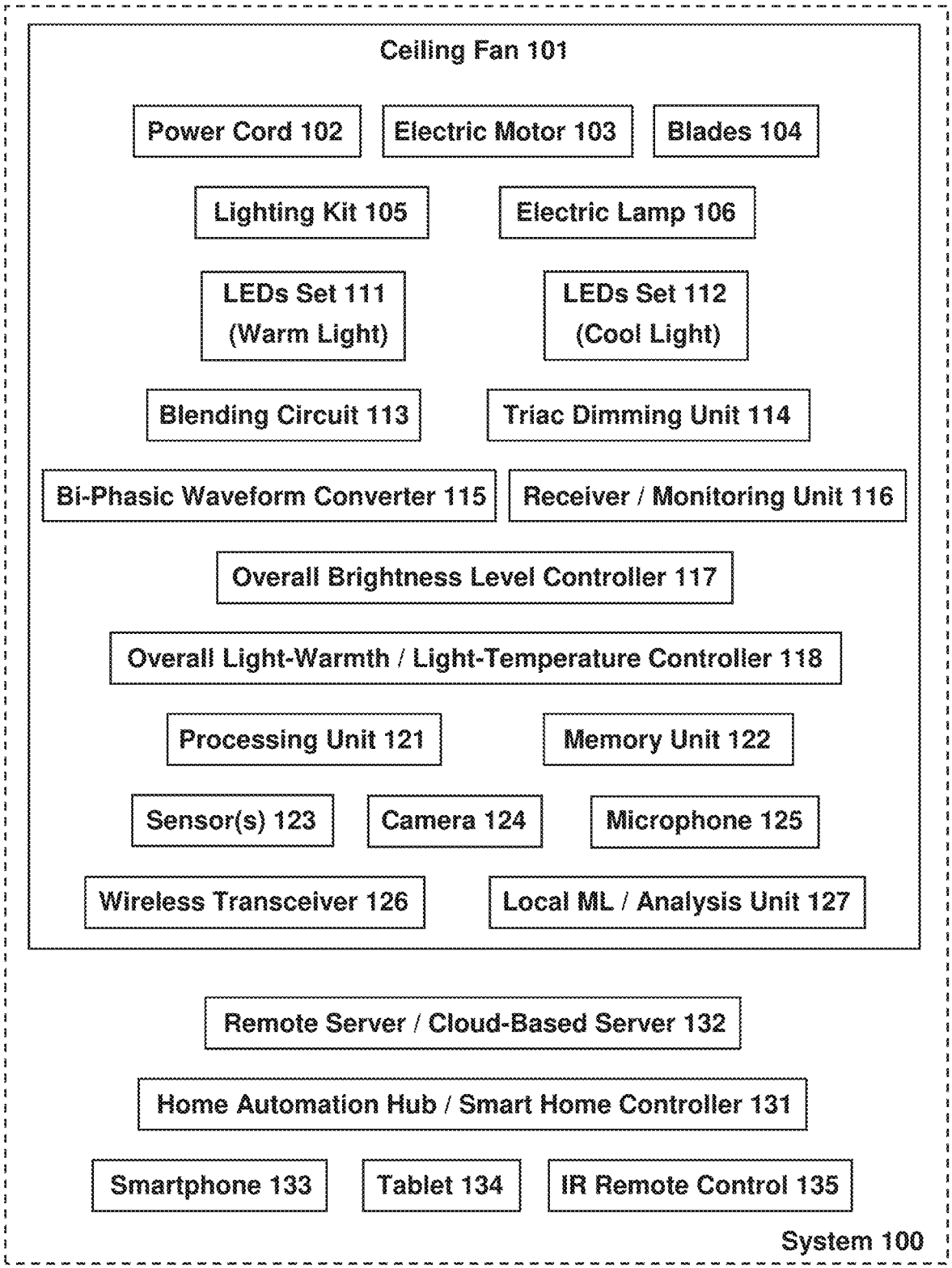
FIG. 1 is a schematic block-diagram illustration of a system, in accordance with some demonstrative embodiments.

Some embodiments provide illumination unit(s) and/or electric lamps and/or light fixtures having Continuous Color Temperature Control; particularly by providing and utilizing Biphasic Dimming or bi-phasic dimming or dual-phase dimming mechanism(s) and/or circuit(s).

In some embodiments, the illumination unit may be a stand-alone illumination unit or a stand-alone lighting fixture or a stand-alone lighting device or electric lamp. In other embodiments, the illumination unit may be integrated with, or may be an integrated component of, or may be part of, for example: a ceiling lamp; a ceiling fan that is capable of producing and providing visible light; a recessed lighting fixture; a home lighting unit or lighting fixture; an office lighting unit of lighting fixture; an indoor lighting fixture or lamp; an outdoor lighting fixture or lamp; a vehicular illumination unit (e.g., illuminating the cabin of the vehicle or portions thereof; illuminating an interior of a vehicle or train-car); an illumination unit of an autonomous car or an autonomous vehicle, or of a self-driving car or a self-driving vehicle; an illumination unit of a boat or ship or yacht or submarine or other marine vessel (e.g., illuminating a cabin of, or within, such marine vessel); an illumination unit within (or of) an airplane or aircraft or a flying device (e.g., a drone, a self-flying or autonomous drone, an Unmanned Aerial Vehicle (UAV), or the like); an illumination unit of or within a spaceship or a spacecraft; a home appliance (e.g., illuminating an internal cavity of a refrigerator or freezer or oven or microwave oven or wine cooler); an illumination unit of a habitat or an office or other structure; an illumination unit within a device or vehicle or spacecraft or habitat that is located externally to Earth (e.g., a Lunar or Martian habitat, or a spaceship-based or spacecraft-based based habitat, or a stellar or interstellar habitat or vehicle); and/or other suitable devices that may integrate or include or contain or utilize such illumination unit.

Some embodiments may implement control of Correlated Color Temperature (CCT) in a hybrid product or a combination product of (i) a ceiling fan and (ii) an illumination unit or lighting fixture or lamp; without the need for additional components or additional wires, and without introducing light blinking or light flickering or other limitations on the user experience from which some conventional systems suffer.

The Applicants have realized that some ceiling fans attempt to utilize conventional methods in order to attempt to achieve CCT control. However, realized the Applicants, the conventional methods suffer from imperfections and various problems.

The Applicants have realized that in a first type of system, a Light Kit Swap is used. For example, the ceiling fan is available for purchase with a choice of one out of several light kits. A consumer who wishes to use warmer light may purchase and install a light bulb or a light kit of 3,000 K; whereas, a consumer who wishes cooler light can purchase and install a light bulb or a light kit of 9,000 K. Changing the color temperature requires getting on a ladder and manually replacing the light bulb or light kit.

The Applicants have realized that in a second type of system, a Mechanical Switch is used. For example, a ceiling fan may include two co-located illumination units: a warm-temperature illumination unit (e.g., 3.000 K), and a co-located cold-temperature illumination unit (e.g., 9,000 K). The user may utilize a physical switch in order to manually activate, selectively, only one of those two illumination units, to thus achieve either a first type of light (e.g., the warmer light) or a second particular type of light (e.g., the cooler light).

Some embodiments of the present invention provide a light kit or a light bulb for a ceiling fan, or an illumination unit, or a lighting fixture, or a lighting apparatus, which enables the user to control, in a continuous and non-abrupt manner, the color temperature or the warmth level or the coolness level of the overall light that is emitted by the illumination unit.

For example, in some embodiments, a light kit has two LEDs, or two sets of LEDs; for example, a first LED of 2,000 K. and a second LED of 9.000 K; or, a first set of LEDs of 2.000 K. and a second set of LEDs of 9.000 K.

Each one of the two LEDs, or each set of the two sets of LEDs, is preceded by a half-wave rectifier (and not a full-wave rectifier), which is connected or located ahead of each such LED (or, ahead of each of the two sets of LEDs).

Accordingly, a receiver and an associated controller can independently operate the warm and cool LEDs (or sets of LEDs), by separately dimming the positive and negative halves of the sinus waveform. The positive half of the bi-phasic waveform drives only the Warm set of LEDs, because of a half-wave rectifier diode that is also included in the light kit. Similarly, the negative half of the bi-phasic waveform drives only the Cool set of LEDs, because of a half-wave rectifier diode that is also included in the light kit.

In some embodiments, the receiver (and/or its associated controller) does not require any additional components to accomplish this. For example, the receiver is capable of monitoring the incoming Alternate Current (AC) waveform; and it includes a triac or a triac dimmer or a triac dimming unit, which is capable of enabling flow of electricity at any point, and it utilizes the feature of a triac such that the electricity continues to flow until the AC waveform reaches a zero-crossing (0 volts). In some embodiments, the receiver may require a firmware modification or a firmware configuration, in order to achieve the bi-phasic waveform described above.

Some embodiments thus do not limit the user to selecting among a pre-defined set of CCT values (e.g., selecting only among two or three pre-defined, discrete, spaced-apart, CCT values, such as 3,000 K or 9,000 K). Rather, in some embodiments, the receiver can now achieve arbitrary and/or continuous combinations of brightness/warmth/coolness or color temperature between the Warm (or warmest) level and the Cool (or coolest) level of the LEDs or of the sets of LEDs; which are mixed and thus appear, in the eye of the user/consumer, as blending to form a single apparent color temperature, such that the entirety of the illumination device provides a unified illumination output having the overall color temperature as requested by the user.

Additionally, some embodiments do not require the receiver (or any other component of the ceiling fan, or of the illumination device or the light fixture or the electric lamp) to perform signaling via power blinking or via power flickering or by power de-activation and re-activation, and without blinking or flickering the electrical signal that is provided to any of the LEDs, and without causing a disruptive or a distracting illumination blink or illumination flicker, and without blinking or flickering any visible light or any light (visible or non-visible). Rather, some embodiments enable modification of the color temperature by a single AC waveform cycle (e.g., 1/60 of a second in the United States; or 1/50 of a second in Europe).

Modified Triac Waveform:

Some embodiments use a modified triac dimmer, which can be an inexpensive and cost-effective component. Once the triac is switched on, it continues to conduct until the AC waveform reaches the next zero-crossing. Therefore, for a given full cycle of an input AC waveform ($2\pi$), the set of all possible output waveforms has only two degrees of freedom, corresponding to: (I) the phase at which the triac is switched on during the crest of the wave ($\pi$-$\varphi$+), and (II) the phase at which the triac is switched on again during the trough of the wave ($2\pi$-$\varphi$−). As a result, the positive half cycle is "on" for a phase-duration $\varphi$+, whereas the negative half cycle is "on" for phase-duration $\varphi$−. In some embodiments, there may be special cases where the triac is not turned on in either (or both) phases; which correspond to the cases $\varphi+=0$ or (and) $\varphi-=0$. There may also be special cases where the triac is immediately turned on for either (or both) phases, which correspond to the cases $\varphi+=\pi$ or (and) $\varphi-=\pi$.

A conventional dimming waveform has the same positive and negative phase-durations, such that $\varphi+=\varphi-$, thus leaving only a single degree of freedom. In such a conventional system, brightness of 100% is achieved when $\varphi=\pi$. In such a conventional system, brightness of 0% is achieved when $\varphi=0$.

In accordance with some embodiments, intermediate values of $\varphi$ may be used to achieve intermediate values of brightness. The relationship is non-linear, due to the shape of the sine wave. The exact nature of the non-linear relationship depends on (or, may be configured by selecting) the types of LEDs and/or LED driver circuits that are used. Some embodiments may be used with various kinds of LED drivers, or even with incandescent or other purely resistive loads.

in which case the system may derive that the brightness B resulting from a phase-duration cp is given by:

$$B=(\varphi+\sin 2\varphi)/\pi$$

If a conventional (non-modified) waveform is used, then CCT cannot be adjusted (at all, or in a continuous or gradual manner) because there is only one degree of freedom.

In contrast, in accordance with some embodiments, the modified dimming waveform of the present invention utilizes $\varphi+$ and $\varphi-$ that can have different values, and thus there are two degrees of freedom corresponding, in a non-linear way, to the brightness of the Warm LEDs (Bw) and the brightness of the Cool LEDs (Bc):

$$Bw=(\varphi++\sin 2\varphi+)/\pi$$

$$Bc=(\varphi-+\sin 2\varphi-)/\pi$$

In accordance with some embodiments, the overall brightness of the overall light (e.g., the blended light, the unified light as it blends from all the LEDs) is thus:

$$B=2(Bw+Bc)$$

Let the color temperature of the warm and cool LEDs be denoted by Tw and Tc, respectively.

The total (or the overall) color temperature T is a function f of the color temperatures and brightness values of the two LED sets:

$$T=f(Bw,Tw,Bc,Tc)$$

This may be approximated linearly as:

$$T=BwTw/B+BcTc/B$$

Accordingly, the two degrees of freedom in the triac waveform (φ+ and φ−) can be transformed into the two degrees of freedom which are relevant to the user of the illumination device, namely B and T.

In a demonstrative and non-limiting example, the user desires illumination having an overall color temperature of T=4000K at 50% brightness (B=½). The light kit (the illumination device) includes a first LED (or, a first set of LEDs) that is Warm (e.g., having Tw=3,000 K), and a second LED (or, a second set of LEDs) that is Cool (e.g., having Tc=9,000 K). The above equations now form a system of algebraic equations which may be solved using algebraic techniques to find the required φ+ and φ− values, which the triac should use in order to achieve the desired brightness and color temperature. Unique solutions exist for any brightness value in the range of 0% to 100%, and for any color temperature between in the range of Tw to Tc, and may be programmed into the receiver (e.g., of the ceiling fan; or into a suitable controller or IC) using logic elements and/or using a lookup table.

Modified Circuit:

In some embodiments, the receiver does not require any circuit modification, provided that it uses triac dimming and can detect the phase of the waveform. This is an effective, cost-reduced design.

The modified light kit circuit includes two input terminals: hot or "line" (L), and neutral (N). The line terminal proceeds to a standard (unchanged) voltage suppression circuit, which includes resistors R1 and R2 and varistor RV1. The values of these components depend on the voltages and currents for which the light kit is structured; for example, typical values may be in the range of 100 Ohms for the resistors and 250 Volts for the varistor.

Next, the circuit reaches two half-wave rectifier diodes D1 and D2, having typical values of 2V forward voltage drop. 1 kV repeated reverse working voltage, 1A continuous current handling, and 1 W power dissipation. Other types of diodes may be used, such as Schottky low-forward-voltage diodes, for example in order to decrease the power loss that may be associated with the rectification. Other suitable values may be used.

After D1, the positive current proceeds to an LED Driver unit, which is an IC or set of discrete electrical components, or a collection or combination of discrete electrical components and one or more ICs. The LED driver unit converts the crudely-rectified waveform from D1 into an appropriate voltage and current for the LED string. In accordance with some embodiments, there are various possible structures for the LED string and the LED driver unit. The choice of LED string configuration may include, for example, how many LEDs in series and/or in parallel are used, the number of such LED units, their arrangement only in series or only in parallel or in another arrangement, their voltage or current values, the relevant configuration of ballast resistors, the voltage drop on LEDs, and other characteristics of the circuit may be configured to achieve particular goals, and in turn may determine the appropriate configuration of the LED driver unit and/or the LEDs string(s) or LED circuit(s).

In accordance with some embodiments, the LED driver unit and the LEDs circuit, together convert the electrical energy available after D1 into light that is emitted by the LEDs. In some embodiments, a capacitor C1 operates to reduce ripple and/or flicker of the LEDs; for example, by storing energy during the period of time when the triac is shut off, or when the triac waveform is active in the negative phase. This may be up to one full cycle of the AC waveform, or typically 1/60 of a second (in the United States), which is a sufficiently short time for a practical sized capacitor to store energy.

The exact same circuit is duplicated after D2, but with LEDs having a different color temperature, and using a capacitor C2.

Finally, the LED driver unit or the LED driver circuit connects to the neutral line, which is the return for the electricity back to the main AC supply.

In some embodiments, continuous or gradual or non-abrupt or smooth adjustment or modification of the color temperature of the overall blended light that is emitted by the illumination unit, may be achieved. For example:

(A) The consumer configures the illumination unit (or the ceiling fan, if the illumination unit is a part of the ceiling fan) for Human Centric Lighting.

(B) The illumination unit or the ceiling fan utilizes an internal real-time clock (RTC) and/or astronomical clock and/or atomic clock and/or other suitable clock or time-measuring unit or time-tracking unit, to determine the time of day or the time of solar day (solar elevation).

(c) The illumination unit or the electric lamp or the ceiling fan may take into account one or more pre-defined or configurable user preferences; such as, typical or pre-defined waking hours/sleeping hours/absence hours, past user behavior based on smartphone or other electronic device data (e.g., time-slots in which the user is known to be reading a book, or is known to be watching television, or is known to be jogging outside, or is known to be working on a computer). This information may be obtained from a Home Automation Hub or from an electronic home assistance (e.g., similar to an Amazon Alexa device), and/or from specific end-user devices (e.g., smartphone and smart television of the user) which are configured as part of the same network or the same user account. In some embodiments, optionally, this information may be obtained by the illumination unit or by the ceiling fan, using an integrated or an external camera or imager, which may take photos or videos of the environment (e.g., with user consent), and may perform image recognition or computer vision analysis to deduce the user's presence and activities at different time-slots.

(D) Using the above information, the illumination unit or the ceiling fan's module or circuit or controller or processor, or its Wi-Fi module or other on-board microcontroller or Integrated Circuit (IC) or logic unit, may periodically re-compute the appropriate brightness and CCT value for the light kit, in order to optimize the health and comfort of the user, and/or in order to dynamically and autonomously adapt the warmth or coldness (or coolness) level of the illumination color to the user's activities and/or the user's preference. For example, the illumination unit or the ceiling fan may determine or may estimate or may know that the user is engaging in book reading every day at 5 PM, and may thus provide cold temperature illumination of 8,500 K at that time for a time-slot of 15 minutes. Conversely, the illumination unit or the ceiling fan may determine or may estimate or may know that the user is engaging in movie watching every day at 9 PM, and may thus provide warm temperature illumination of 3,200 K at that time for a time-slot of 45 minutes. Such knowledge of the user's preferences or habits may be obtained or derived from one or more sources; for example, based on manual input of the user (e.g., the user inputs via a computerized interface or a smartphone that he prefers cold illumination between 8 PM to 9 PM in his bedroom), and/or based on contextual analysis of a calendar or schedule on the user's smartphone or account (e.g., the user's schedule indicates a time slot for reading books), and/or based on one or more cameras or imagers or sensors that detect or recognize particular activities (e.g., a camera that captures images or videos, and a computer vision processor, which may be local or remote or cloud-based, that recognizes a reading activity depicted in those images or videos at a particular time-slot), and/or based on one or more microphones or other sensors that collect data that can be processed to recognize a user activity (e.g., an acoustic microphone that captures audio, and an audio processing unit that recognizes that the audio represents User Adam reading a book with bedtime stories to Daughter Jane).

In some embodiments, if the user asks for a specific CCT value (e.g., "3,456 K"), then there may not be a need to re-compute the parameters or to modify them. In some embodiments, the user may ask for automatic HCL or for "Automatic Adjustment of CCT value"; and in this mode, the illumination unit may operate autonomously to adjust the CCT value dynamically, at pre-defined time intervals (e.g., every second, every minute, every hour, every day, or the like) based on the circadian rhythm of the specific user and/or based on a pre-defined pattern of CCT values and their corresponding time-slots, and while automatically performing such adjustments and modifications of the CCT values in a continuous and smooth and gradual manner that does not require and does not involve any power signaling or visual blinking or visual flickering or other disruption to the user experience.

In some embodiments, these computations may be performed remotely, in a remote server or in a cloud-based server, which may receive the data from the illumination unit or from the ceiling fan via an Internet connection or a Wi-Fi communication link or a cellular communication link or via a wired link or via a Home Automation Hub or via an electronic home assistant device (e.g., similar to an Amazon Alexa device). alternatively occur in a cloud server, or in a combination of cloud and local microcontroller. The remote server may then send back, to the illumination unit or the ceiling fan, commands to modify the brightness and/or the color temperature of the illuminated light, based on such remote analysis of the data.

In some embodiments, some or all of the calculations and the determinations may be performed locally, within the illumination unit or the ceiling fan itself; or within a processing unit that is co-located with them. In some embodiments, some or all of the calculations and the determinations may be performed by a Home Automation Hub or a home automation device, or by an electronic home assistant device (e.g., similar to an Amazon Alexa device), which may perform such calculations and may then send a wireless signal to the illumination unit or to the ceiling fan, indicating a command to modify the brightness and/or the color temperature of the illuminated light. In some embodiments, the calculations may be distributed across two or more units or devices or servers, which may be local and/or remote relative to the illumination unit or the ceiling fan.

In some embodiments, the illumination unit's or the ceiling fan's receiver or circuit converts from the (B,T) values into the phase-durations ($\varphi+$ and $\varphi-$) for the triac using the algebraic equations as shown above.

In some embodiments, the illumination unit's or the ceiling fan's receiver or circuit operates the triac 120 times per second (e.g., assuming standard US mains frequency of 60 Hz) or 100 times per second (e.g., for European or other international AC grids that use 50 Hz). The receiver or the circuit monitors the input waveform phase to determine the timing of triac operation.

In some embodiments, as described by the above mathematical calculations and the circuit description, these phase-durations generate a modified triac dimming waveform, which generates a mixture of blended LED lights, that achieves the desired brightness and color temperature.

In some embodiments, each time the illumination unit or the ceiling fan re-computes the desired color temperature (which may be once per second, or as frequently as every AC cycle, or as infrequent as once per minute or once per day, or may be pre-computed for a day with predetermined transition times), the phase-durations may be adjusted and the color temperature may also be adjusted.

These adjustments may be arbitrarily small (infinitesimal in the limit), and they require no blinking and no flickering and no other interruption to the energy supplied to the LEDs; such that the user is not subject to any abrupt change or any abrupt adjustment in the moment. Rather, the continuous and gradual adjustment of CCT and/or brightness level delivers comfort without annoyance of blinking or abrupt changes.

The user may interface with the CCT adjustment mechanism and/or the brightness level mechanisms in one or more ways, for example:

(a) Via a slider control in a smartphone application or a tablet application or a laptop application or a desktop computer application.

(b) By manually entering or typing a CCT value in Kelvin into the interface of a smartphone or tablet or laptop computer or desktop computer.

(c) Via an Application Programming Interface (API); for example, using HTTP or HTTPS to send a PUT request to the Wi-Fi module inside the illumination unit or the ceiling fan with an action "SetColorTemperature" and argument "5,000" or other in-range value in Kelvin.

(d) Via voice commands, that may be delivered to the illumination unit or the ceiling fan directly (e.g., if such device is equipped with a microphone and with a speech-to-text converter and analysis unit), or indirectly via an Alexa device or a Google Home device or a Josh.ai device or other similar device.

(e) Via an integration that uses the API, such as Control4, Crestron, Savant, or Home Assistant.

(f) By enabling Human Centric Lighting (HCL) feature, which continuously adjusts in an autonomous manner as described above.

(g) By enabling a Human Centric Lighting feature and powering up the device using a wall switch (which may be "dumb" or "smart"), which signals to the receiver that the CCT value should be adjusted for a particular time of day.

(h) Via an RF (or BLE or Wi-Fi or IR) remote control, which may be hand-held or wall-mounted or table-mounted, containing one CCT button which may be pressed once to cycle to the next of several preset CCT values; or in other embodiments, which may be held down to continuously adjust CCT value until the desired value is reached, at which time the user lifts their forger from the button and the modification stops.

(i) Via a remote control with two buttons, one to increase CCT (cooler) and one to decrease CCT (warmer).

(j) Via a dedicated remote control unit, having a physical slider that enables the user to gradually modify the CCT value, and having another physical slider that enables the user to gradually modify the brightness level.

(k) Via a dedicated remote control unit, having a rotatable "radio style" button that enables the user to gradually modify the CCT value, and having another rotatable "radio style" button that enables the user to gradually modify the brightness level.

(l) Via a dedicated remote control unit, having a touch-screen with an on-screen interface (e.g., sliders, buttons, drop-down menu, rotating elements), that enables the user to gradually modify the CCT value and to gradually modify the brightness level.

In some embodiments, a cloud-based device or server, or other remote server, may include a Machine Learning (ML) engine and/or a Deep Learning (DL) engine and/or an Artificial Intelligence (AI) engine and/or a Neural Network (NN) based analysis unit, which may be fed with data that corresponds to several days (or weeks, or months) of utilization of the illumination unit and/or the ceiling fan by the specific user; and which may generate or construct a model, such as an ML model, which may allow such unit to predict or to estimate the preferences of the user for particular CCT values and/or particular Brightness values during particular time-slots; for example, deducing from data collected over 30 days, that the user prefers 3,612 K color temperature from 6 PM to 7 PM on weekdays, and that the user prefers 8,437 K color temperature on weekends from 9 AM to 10:15 AM, and so forth.

For example, such ML/DL/AI/NN analysis unit or engine may receive proactive state updates from the illumination unit and/or ceiling fan, indicating observations of the user's preferences before any automated AI control is commenced. After a period of several days or weeks, there will be adequate data collected with regard to a particular user, to automatically build an ML model that can predict what brightness value and CCT value the user will desire at particular time-slots and/or days or day-portions (e.g., morning, noon, afternoon, evening, night). The model may optionally utilize a NN or other suitable ML model, such as a random forest, decision tree, Extended Isolation Forest, Support vector machines. Naïve Bayes, Gradient boosting, and/or other algorithms. The model is trained on the historical data of actual usage of the specific user, and is then tested continuously using the new actual data that comes in for that user. For example, the model may predict that the user will next request 50% brightness at 5,000K. but when the user actually operates the illumination unit he may request 70% brightness and 4,500K; the difference between the predicted values and the observed values is fed back into the model (or into a re-training unit) to improve and update the model, and/or to compute a confidence level or confidence score. Once the confidence level reaches a pre-defined threshold of acceptable level (for example, 80% confidence interval of plus or minus 20% brightness, and plus or minus 100 K of CCT value), then the ML/DL/AI/NN unit or engine may send a command or a PUSH notification (e.g., from a cloud-based server) to the user asking if they want to enable Intelligent-Color feature, or in some embodiments may send directly a modification command to the illumination unit and/or the ceiling fan to directly modify the brightness value and/or the CCT value. In some embodiments, optionally, if the user enables the feature, then future commands from the user to "Turn On" the light will, instead of restoring the previous brightness and color temperature, enable the Brightness value and the CCT value as computed or estimated dynamically based on the ML model.

Some embodiments may be used in conjunction with, for example: a stand-alone illumination device or lamp or lighting fixture; a Ceiling Fan having an integrated illumination unit or lamp; a light kit for a ceiling fan; Ceiling Fans with separate UP and DOWN light kits, either or both of which may use the above-mentioned features; Smart Chandeliers; Smart Bathroom vanities; Recessed room and hallway lighting (e.g., particularly useful here as the lighting may automatically set a brightness or color temperature when turned on which is appropriate for that time of day, such as a cool but dim light in the midnight hours to simulate moonlight).

Some embodiments may be used to provide indoor light in a spaceship or spacecraft or airplane or aircraft, or in an extra-terrestrial habitat (e.g., Lunar or Martian or stellar habitat) in order to mimic or to simulate or to emulate daylight on Earth and thus reduce stress and increase comfort of occupants (passengers, astronauts, space explorers). Some embodiments may be used in conjunction with (or, within) an extraterrestrial habitat (e.g., a Mars base, a Lunar base, a habitat within a traveling spacecraft), as the continuous and gradual and non-abrupt adjustment or modification of the CCT/Brightness values may be important to maintain circadian rhythms and wellness of the habitat's occupants or passengers, and/or for simulating or emulating or mimicking sunlight (of our Sun. or of Sol) as humans evolved on Earth and are not naturally adapted to being exposed to fixed light level/CCT value/brightness level for extended periods of time.

In some embodiments, a lookup table or pre-defined rules or definitions may be used, in order to define or utilize what a "warm" (or "hot") CCT value is and what a "cool" (or "cold") CCT value is, or which ranges-of-values correspond to various degrees of heat or coolness; for example, based on a lookup table that may be similar to the table of Kelvin values and their characteristics as shown further herein.

In some embodiments, for example, a "warm" light or a "warm" LED may correspond to illumination color temperature of 2,200 K to 3,000 K. In some embodiments, for example, a "cool" light or a "cool" LED may correspond to illumination color temperature of 6,000 K to 9.000 K. Other suitable or ranges may be used.

In some embodiments, the illumination device may enable the user to continuously and gradually modify or set or adjust the CCT value of the overall blended illuminated light, in range of 1.000 K to 10,000 K; or in a range of 2,000 K to 9.500 K; or in other suitable ranges of values; and in some embodiments, in a step-size (or at a resolution of) of 1 K, or in a step-size (or at a resolution of) 0.1 K.

In some embodiments, the entirety of the illumination device includes only two (or exactly two; or at least two) discrete illumination units, such as two LED units; each one of them able to generate (separately) light with a color temperature of up to 10,000 K; as well as a circuit and/or electrical components and/or electrical circuitry and/or an Integrated Circuit (IC) that enables to modify the voltage and/or current and/or the waveform that are provided to each one of those illumination units in order to achieve a blended overall illuminated light having color temperature in the range of 1,000 K to 10,000 K. In some embodiments, the term "illumination unit" mentioned above, may include a set or a string or a batch or a group of two or more co-located LEDs; and particularly, of LEDs that are identical to each other within the same string or set or batch or group.

In accordance with some embodiments, the entirety of the illumination device or the entirety of the electric lamp includes only two (or exactly two; or at least two) discrete illumination units, such as two LED units or two LED strings or two LED arrays or two LED sets; one of them able to generate (separately) light with a color temperature of up to 9,000 K; and the other one of them able to generate (separately) light with a color temperature of up to 2,000 K; as well as a circuit and/or electrical components and/or electrical circuitry and/or an Integrated Circuit (IC) that enables to modify the voltage and/or current and/or the waveform that are provided to each one of those illumination units in order to achieve a blended overall illuminated light having color temperature in the range of 1,000 K to 9,000 K. In some embodiments, the term "illumination unit" mentioned above, may include a set or a string or a batch or a group of two or more co-located LEDs; and particularly, of LEDs that are identical to each other within the same string or set or batch or group.

In some embodiments, any of features discussed above and/or herein, even if discussed in the context of a ceiling fan, may actually be implemented (in some embodiments) in an illumination device or illumination unit or illumination fixture that is not associated with any fan or any ceiling fan.

In accordance with some embodiments, any of features discussed above and/or herein, even if discussed in the context of a stand-alone illumination unit or electric lamp, may actually be implemented (in some embodiments) in an illumination unit or electric lamp that is an integral part of a ceiling fan or that is an integrated part of a ceiling fan or that is an add-on to a ceiling fan or that is operably associated with a ceiling fan or that is co-located within or near or below a ceiling fan.

In some embodiments, a lookup table may be used to define what is a "warm" light or what is a "cool" light; particularly in order to assist the end-user in selecting which light-temperature to request. It is noted that the following lookup table. Table 1, shows 9 demonstrative values or ranges-of-values that are indicated in round numbers (e.g., numbers that divide by 100 or by 1,000); however, embodiments of the present invention may enable a user to request, and to achieve, virtually any value (e.g., 4,567 Kelvin) and not only discrete values and not only rounded values.

TABLE 1

| Kelvin | Type/Characteristics |
|---|---|
| 1,000 K | Candlelight red/yellow |
| 1,800 K | Ultra Warm: vintage look of filament lamp; orange |
| 2,400 K | Very Warm; hospitality lamp style |
| 2,700 K | Warm; yellow; conventional Halogen lamp |
| 3,000 K | Warm White |
| 4,000 K | Cool White; compact fluorescent light (CFL) |
| 5,000 K | Daylight |
| 6,000 K to 7,000 K | Cool Daylight |
| 10,000 K | Blue or Bluish light; blue sky |

Reference is made to FIG. 1, which is a schematic block-diagram illustration of a system 100, in accordance with some demonstrative embodiments. System 100 may include a Ceiling Fan 101, having an Electric Moto 103 that rotates a set of Blades 104. Ceiling Fan 101 further includes or contains a Lighting Kit 105 having an Electric Lamp 106. In some embodiments, a single Power Cord 102 or power cable provides A/C power from a mains socket to the Ceiling Fan 101 and all its components.

Electric Lamp 106 includes at least two sets of LEDs; for example, LEDs Set 111 which emits visible Warm Light (e.g., 2,000 K) if connected by itself to a power source without any particular waveform-modifying circuit; and LEDs Set 112 which emits visible Cool Light (e.g., 9.000 K) if connected by itself to a power source without any particular waveform-modifying circuit. The blending of emitted light, and the particular modification of the overall brightness and/or temperature of the overall emitted light, are performed by a Blending Circuit 113, a Triac Dimming Unit 114, a Bi-Phasic Waveform Converter 115, a Receiver/Monitoring Unit 116, and/or other electric components. The operational characteristics of such components may be dynamically modified, in response to user commands and/or in response to autonomous (locally-determined and/or remotely-determined) decisions with regard to preferred brightness/light-temperature values, via an Overall Brightness Level Controller 117 and an Overall Light-Warmth/Light-Temperature Controller 118. A Processing Unit 121 and a Memory Unit 122 may perform calculations for implementing such modifications.

Optionally, the Ceiling Fan 101 may include, or may be co-located near, a Camera 124, a Microphone 125, and/or one or more Sensors 123 (e.g., temperature sensor, humidity sensor, Carbon Monoxide (CO) sensor, or the like). Data and/or measurements collected by such sensors may be analyzed locally at a Local ML/Analysis unit 127; and/or may be transmitted via a Wireless Transceiver of the Ceiling Fan 101 to a Remote Server/Cloud-Based Server 132 for remote ML processing or remote analysis, such that Server 132 then transmits back to the Ceiling Fan 101 the processing results and/or a message indicating commands for modifying operational properties of Ceiling Fan 101. Ceiling Fan 132 may further be in wireless communication with a Home Automation Hub/Smart Home Controller 131, or similar control unit or hub; as well as end-user's Smartphone 133. Tablet 134, and an Infra-Red (IR) Remote Control Unit 135 which are all able to wirelessly transmit operational commands to the Ceiling Fan 101.

Figure 2:
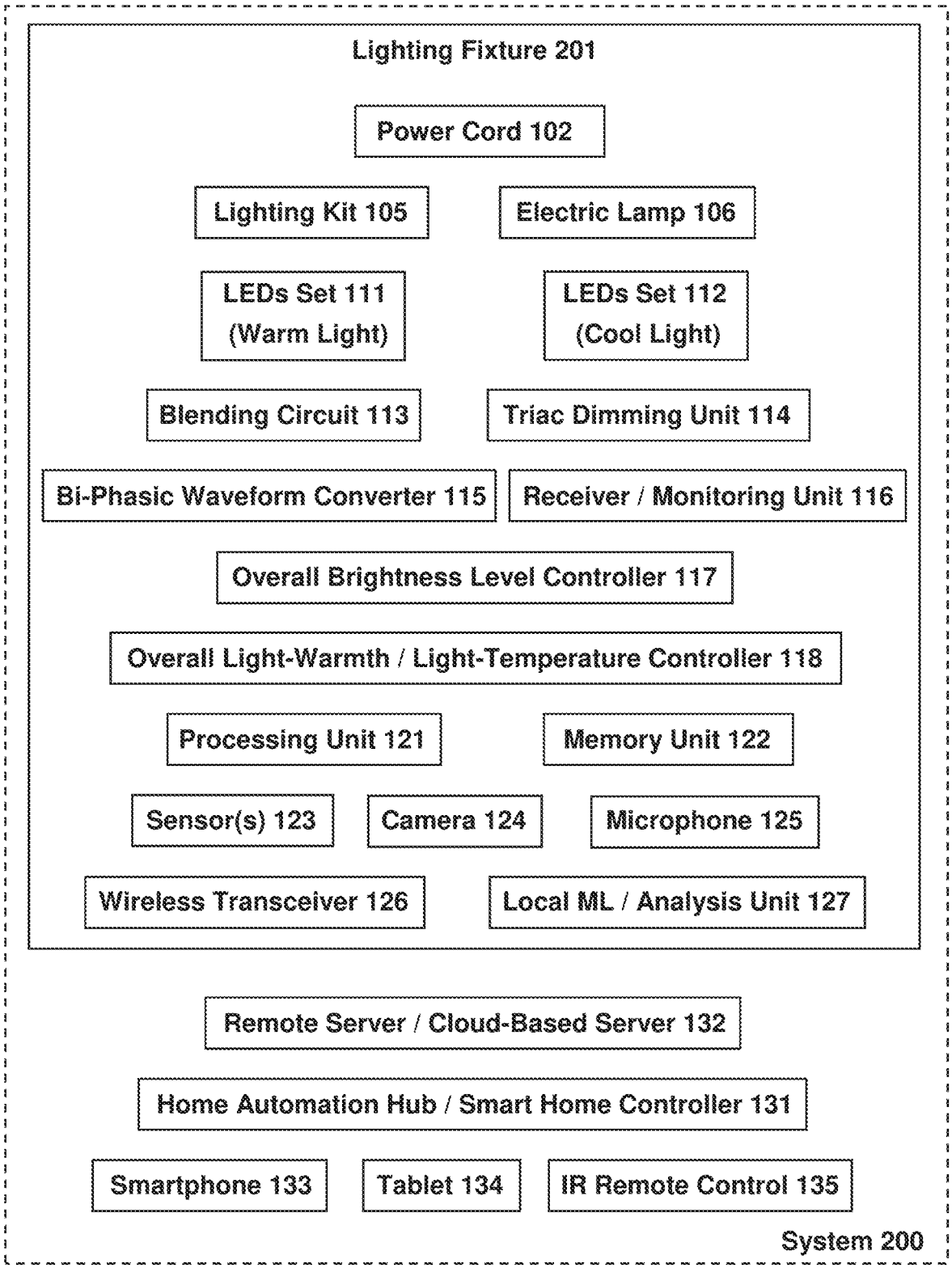
FIG. 2 is a schematic block-diagram illustration of another system, in accordance with some demonstrative embodiments.

Reference is made to FIG. 2, which is a schematic block-diagram illustration of a system 200, in accordance with some demonstrative embodiments. System 200 may include a Lighting Fixture 201; which may have components that are generally similar to those of Ceiling Fan 101 discussed above; yet Lighting Fixture 201 does not include an electric motor or blades. Lighting Fixture 201 may be configured to perform brightness and/or light-temperature modifications, via its Overall Brightness Level Controller 117 and its Overall Light-Warmth/Light-Temperature Controller 118.

Figure 3:
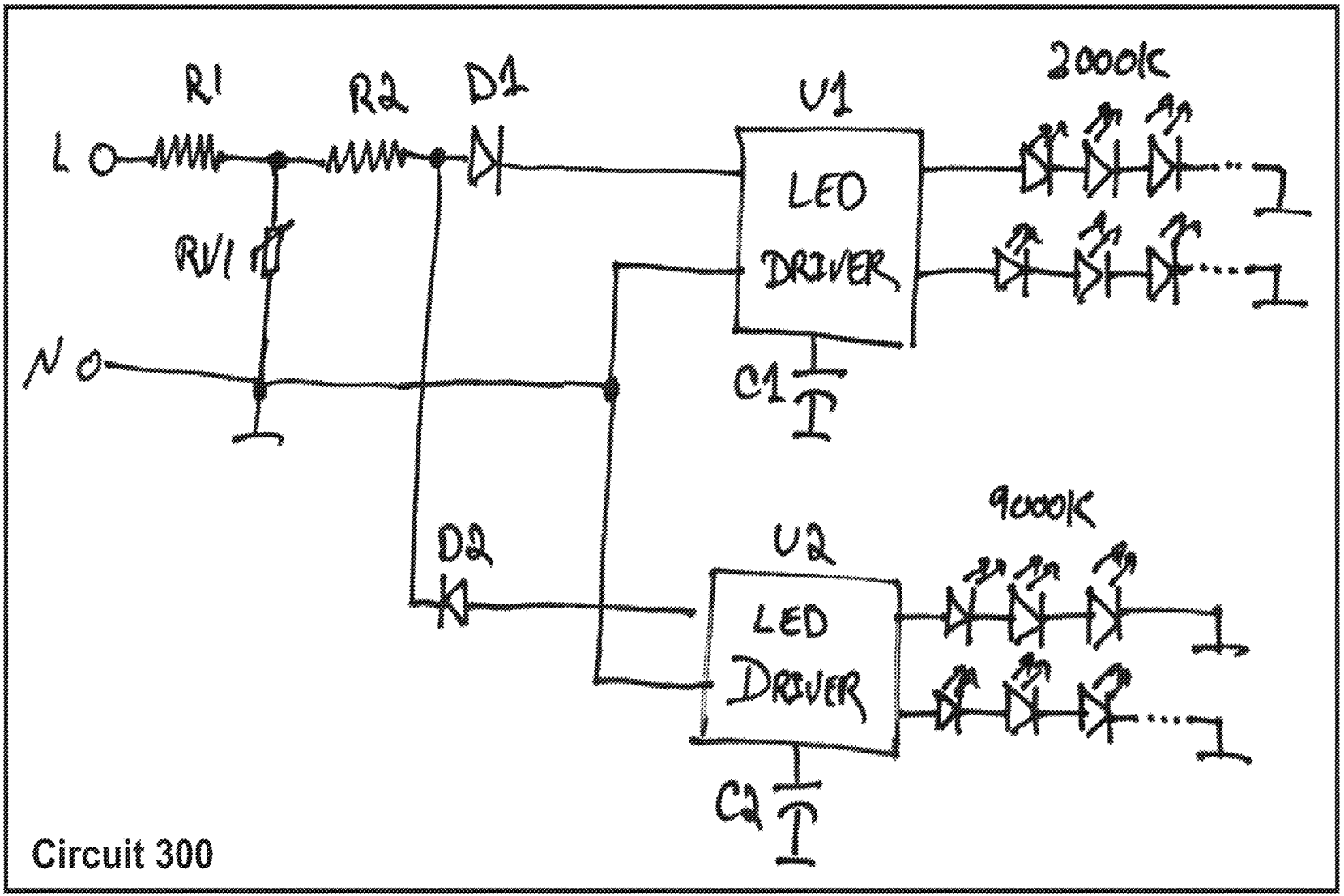
FIG. 3 is a schematic block-diagram illustration of a circuit, in accordance with some demonstrative embodiments.
Figure 4A:
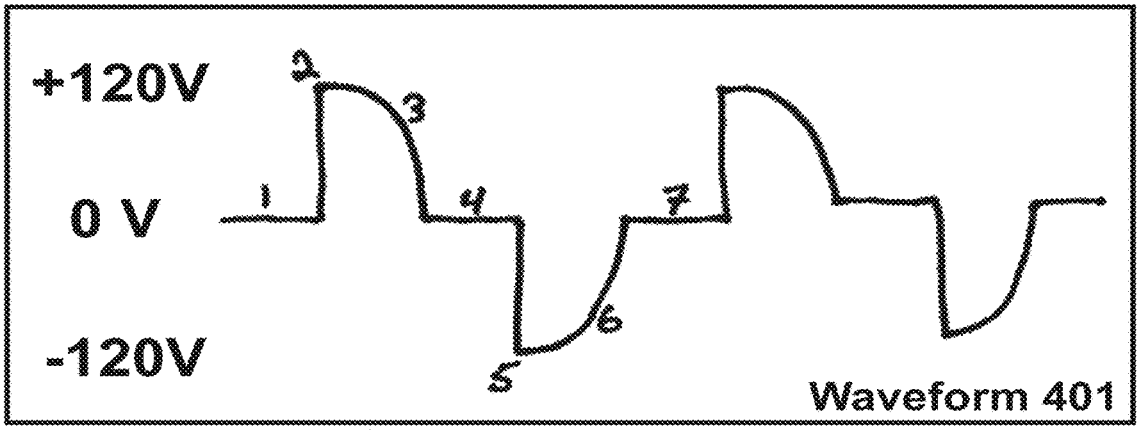
FIGS. 4A to 4D are schematic illustrations of Waveforms of electric power, which may be generated and/or utilized in accordance with some demonstrative embodiments.
Figure 4B:
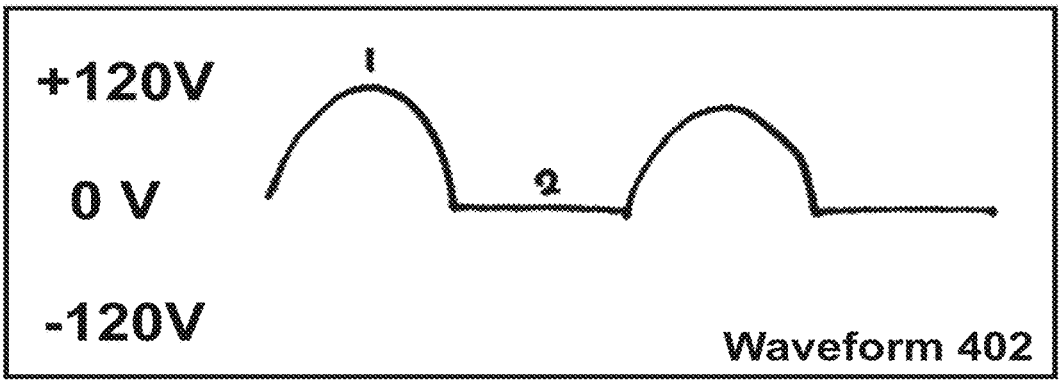
Figure 4C:
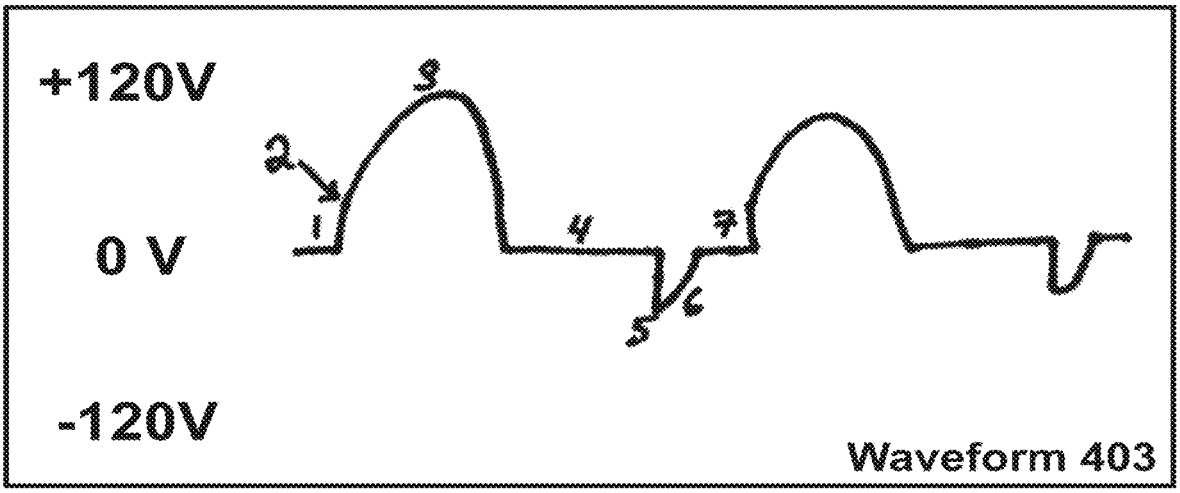
Figure 4D:
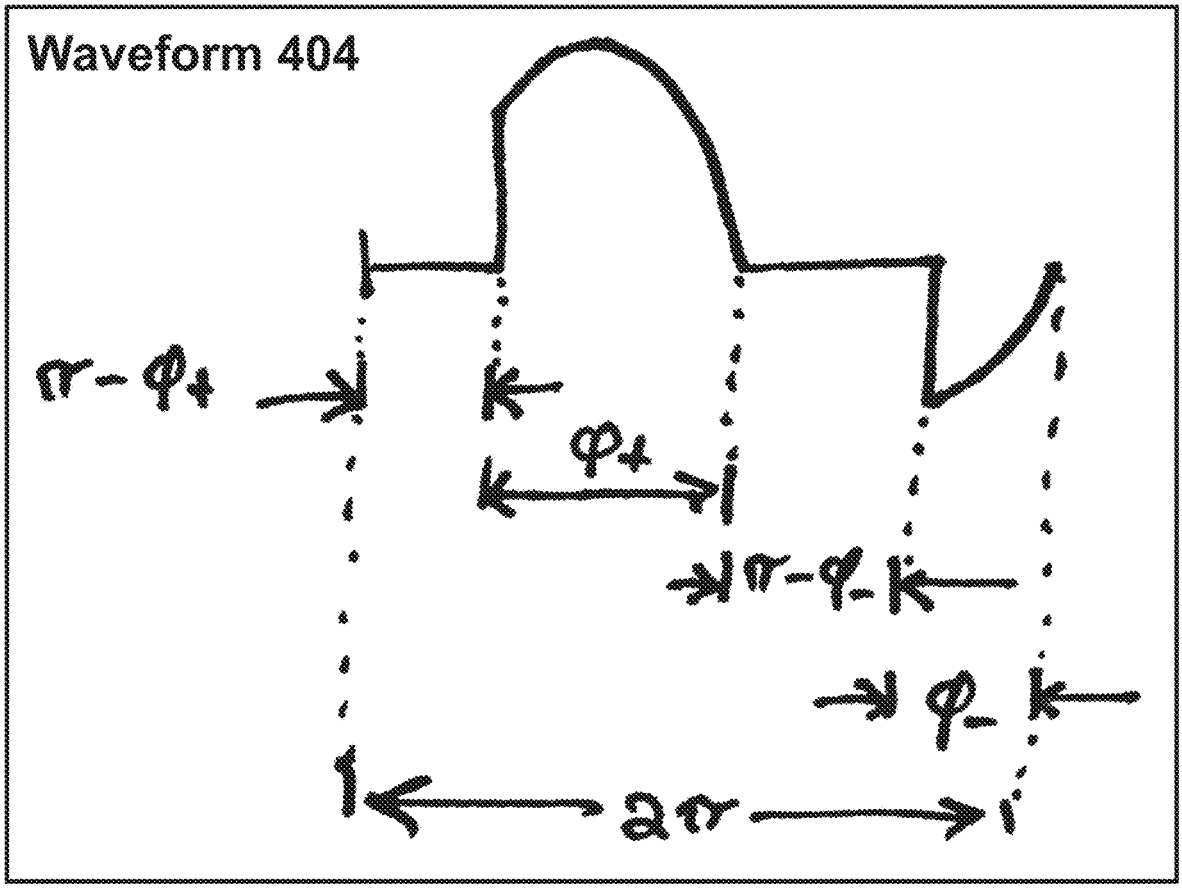

Reference is made to FIG. 3, which is a schematic block-diagram illustration of a Circuit 300, in accordance with some demonstrative embodiments. Circuit 300 may be used to perform brightness and/or light-temperature modifications. Other suitable circuits and/or components may be used.

Reference is made to FIGS. 4A to 4D, which are schematic illustrations of Waveforms 401 to 404 (respectively), of electric power, which may be generated and/or utilized in accordance with some demonstrative embodiments.

Waveform 401 demonstrates the output voltage waveform of a traditional triac dimmer. As demonstrated, the phase angle at which the positive and negative halves of the sinus are turned on (points 2 and 5, respectively) are the same. At point 1, the triac is off while the input voltage is rising. At point 2, the controller switches on the triac. At point 3, we see the output voltage tracking the input along the trailing edge of the positive phase of the sinus. At point 4, the triac has shut off due to the zero crossing. At point 5, the triac is again turned on by the controller. At point 6, the output voltage is again tracking the input voltage along the trailing edge of the negative phase of the sinus.

Waveform 402 demonstrates a half-rectified sinus; this is the maximum voltage waveform which can be delivered to either of the low/high CCT driver units.

Waveforms 403 and 404 demonstrate a waveform that may be generated and used by the triac dimming unit of the present invention. In Waveform 403, we see that the triac can use different phase angles for dimming the upper half of the sinus versus the lower half of the sinus. That is, points 2 and 5 occur at different delays after the previous zero crossing. This permits a different power to be delivered to the LED driver which receives the positive half-wave rectification versus the LED driver which receives the negative half-wave rectification. Waveform 404 provides an illustration of the phase-angle notation relative to the voltage waveform. For example, $\varphi+$ is the duration of phase (in radians) for which the triac is activated during the positive half of the sinus; whereas $\varphi-$ goes for the negative half of the sinus. The $\varphi+$ and $\varphi-$ terminology is used in equations to calculate the expected power and color temperature mix to be achieved.

Figure 5A:
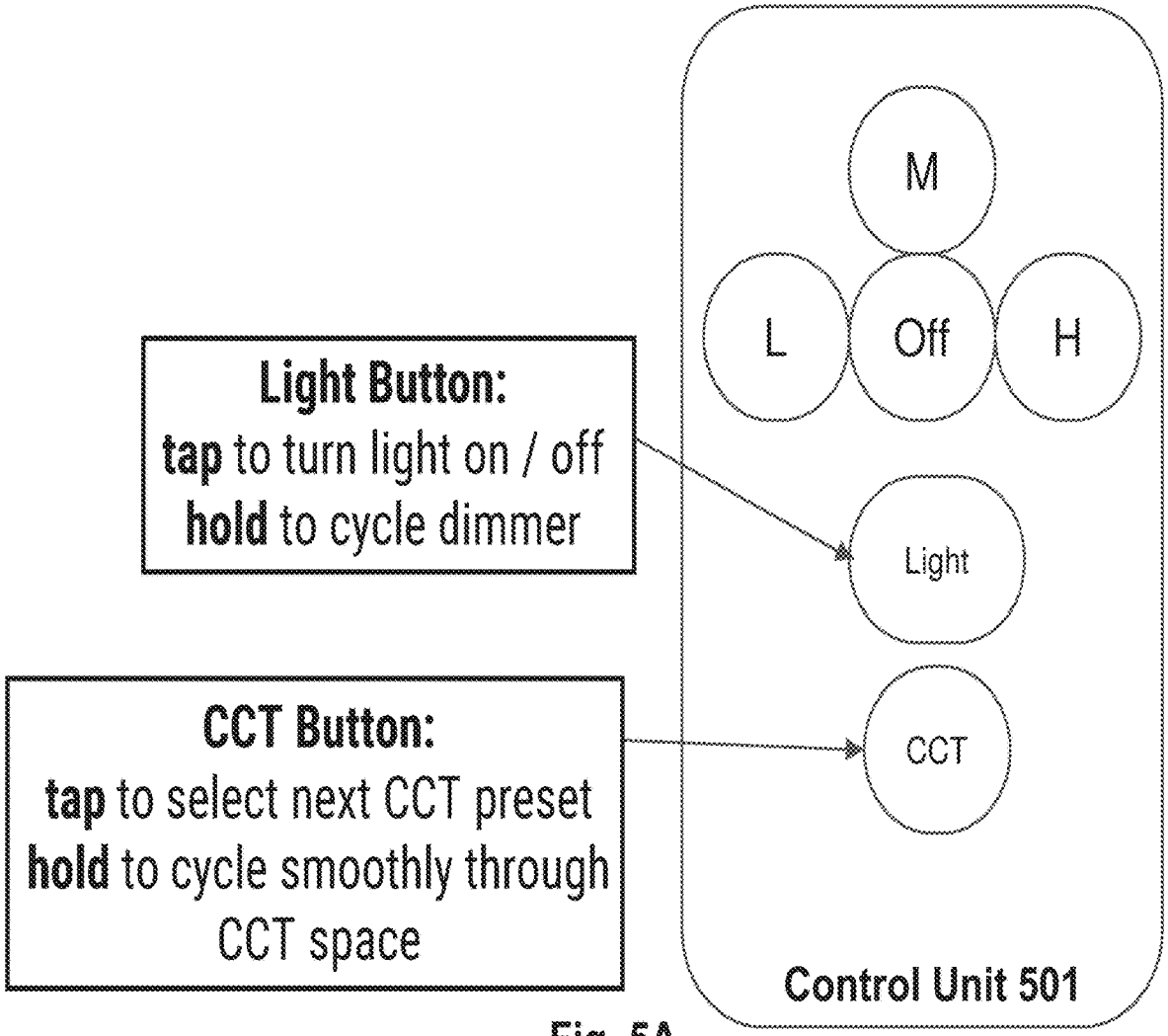
FIGS. 5A to 5C are schematic illustrations of Control Units, in accordance with some demonstrative embodiments.
Figure 5B:
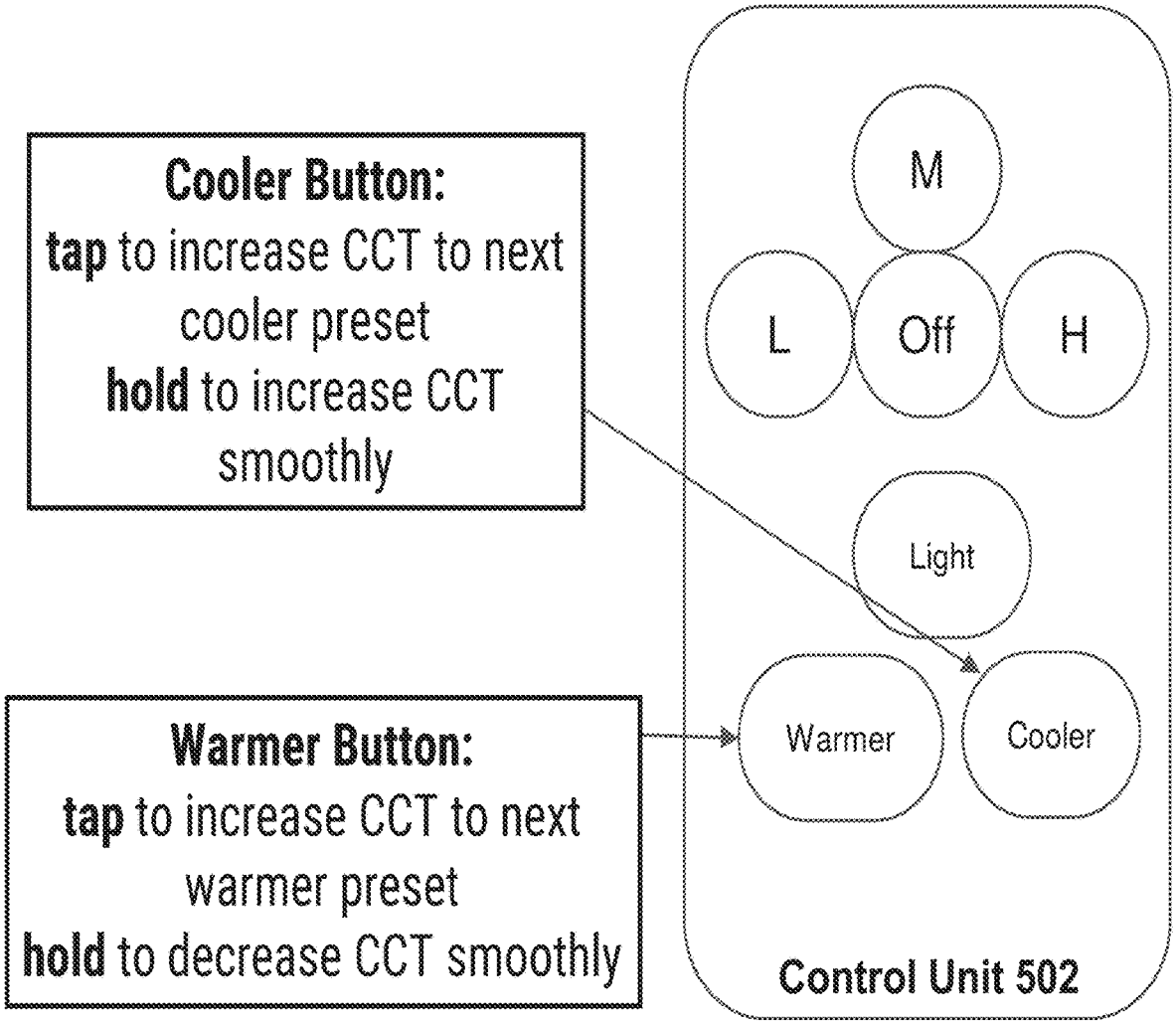
Figure 5C:
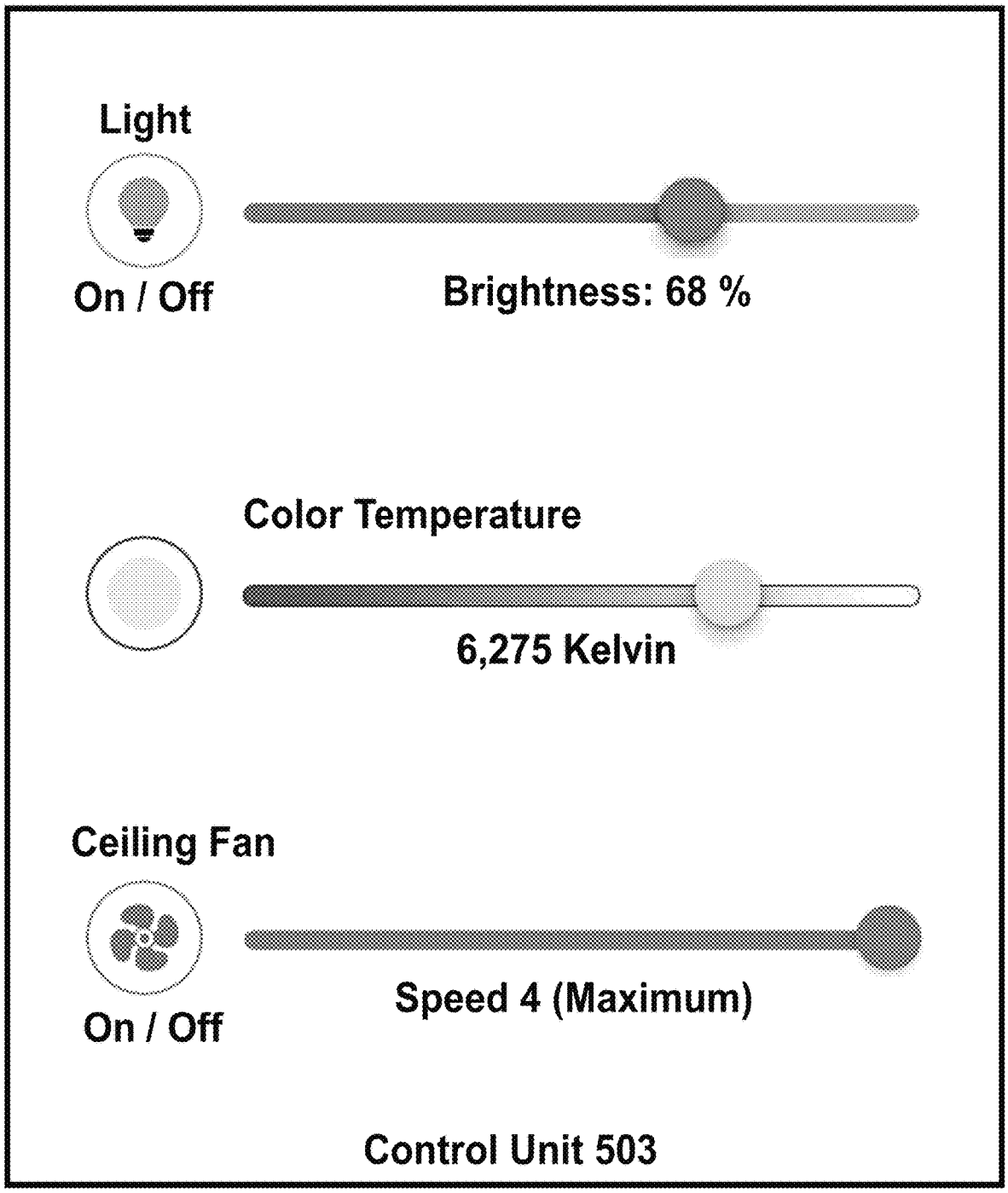

Reference is made to FIGS. 5A and 5B and 5C, which are schematic illustrations of Control Units 501 and 502 and 5C, respectively, which may be used to enable request and enable brightness and/or light-temperature modifications of the overall emitted light, in accordance with some demonstrative embodiments. Control Unit 501 or 502 or 503 may be implemented, for example, as a stand-alone device or control unit; as a handheld or portable remote control (RC) unit; as a wall-mounted control unit; on a touch-screen of an electronic device which may be portable or handheld or wall-mounted; using a touch-screen of a smartphone or tablet or laptop or smart-watch; using a dedicated mobile application or "app"; using a browser-based interface or an in-browser interface or a web browser, as part of a Home Automation Hub or a Home Automation Device or a Smart Home Hub or a Smart Home Control Unit; as part of an Infra-Red remote control unit; as part of a remote control unit that communicates with the ceiling fan and/or with the lighting kit and/or with the electric lamp directly or indirectly, via a Wi-Fi communication link, via a Bluetooth communication link, via a cellular communication link, via a local direct communication link, via a local indirect set of communication links (e.g., relayed or facilitated via a wireless router or a wireless Access Point), via a set of communication links that include local communication link(s) and/or remote (e.g., Internet-based) communication link(s) that may optionally pass through a remote server or a cloud-based server; or the like.

Control Unit 501 provides a single button for CCT functionality; and a click of that single button enables the user to switch among a set of CCT profiles (e.g., having 5 or 7 such CCT profiles), each profile having its own level of brightness and/or light-temperature.

Control Unit 502 provides two buttons for CCT functionality; for example, a button for requesting and commanding to make the emitted light Warmer, and a button for requesting and commanding to make the emitted light Cooler. In some embodiments, each click causes a change of N Kelvins in the temperature value of the overall emitted light; wherein N is a pre-defined value, for example, 1-Kelvin increments, 5-Kelvin increments, 10-Kelvin increments. 50-Kelvin increments. 100-Kelvin increments, 500-Kelvin increments, or the like, or N-Kelvin increments (wherein N is a pre-defined positive number or positive integer). In other embodiments, each click of the Warmer button causes a switch to the next-available Warmer profile and each click of the Cooler button causes a switch to the next-available Cooler profile; and there may be dozens, or even hundreds, of such profiles.

It is noted that these are only two non-limiting examples of Control Units; and other types of control units may be used; for example, having separate Sliders (which may be physical/mechanical/hardware-based sliders; or which may be on-screen sliders) for modifying the temperature value of the overall light, the brightness of the overall light, the rotating speed of the ceiling fan, and/or other operational parameters.

For example, Control Unit 503 provides a first Slider interface for modifying the overall brightness of the emitted light; a second Slider interface for modifying the temperature (the warmth or coolness level) of the overall emitted light; a third Slider interface for modifying the rotation speed of the ceiling fan (e.g., enabling a modification of the rotation speed along a continuous spectrum of speeds; or along a set of pre-defined discrete values of rotations speeds); and also, a first button for turning the light on and off; and a second button for turning the ceiling fan on and off. Other suitable interface elements may be used.

In some embodiments, the current or the user-selected overall CCT value and/or the overall brightness value, as well as the rotation speed of the ceiling fan, may be stored in a non volatile memory unit (e.g., Flash memory) of the ceiling fan itself and/or the lighting kit itself and/or the Control Unit; such that, if there is power loss for a few seconds or even for several hours, the latest values of user-selected overall CCT value and/or the overall brightness value and/or the rotation speed of the ceiling fan can be automatically restored and applied, based on the values that were stored in such non-volatile memory unit.

In some embodiments, a text-to-speech converter may be used, via a Home Automation Hub or other Smart Home device (e.g., Google Home, Amazon Alexa, or the like); to enable the user to provide voice commands such as, for example. "Alexa, set the dining room light to be softer", or "make the living room light warmer", or "set the bedroom light to be cooler", or "make the kitchen light 23 percent cooler", or "change the kitchen light to be 27 percent warmer", or "increase the bedroom light by 234 Kelvins", or "decrease the kitchen light by 347 Kelvins", or "make the bedroom light more blue", or "make the kitchen light whiter", or "set the living room light to daylight", or other commands. In some embodiments, such commands may be conveyed to an acoustic microphone via speech; and/or may be typed by a user into an interface that performs contextual analysis or Natural Language Processing (NLP) to extract the relevant commands.

In some embodiments, color temperature and/or color brightness, of the overall emitted light, may be automatically modified or adjusted by the system based on a pre-defined profile that indicates a Human Centric Lighting (HCL) scheme or a Circadian Rhythm; or based on solar schedule (e.g., based on known times of sunrise and sunset in this particular venue or location, based on a location-finding sensor or GPS component as well as an online database); or based on simulated or emulated solar events (sunrise events, sunset events) which may trigger gradual modification of the brightness values and/or the light-temperature values of the overall emitted light. Other profiles or schemes may be used, or may be pre-defined by the user, or may be autonomously determined and/or applied by the system based on analysis of user activities, analysis of environmental changes or parameters (e.g., cloudy/dark day), or the like.

Some embodiments provide a ceiling fan, comprising: an electric motor, configured to rotate a set of blades; and an electric lamp, which is an integrated component of the ceiling fan and is co-located beneath said set of blades. The electric motor and the electric lamp receive electric power from a mains electric socket via a single electric power cord that provides Alternating Current (AC) power to both the electric motor and the electric lamp. The electric lamp is configured to emit visible light having light warmth at a user-configurable level along a continuous spectrum of light warmth. The continuous spectrum of light warmth, that can be emitted by said electric lamp, is a continuous spectrum between a lower-bound value and an upper-bound value.

In some embodiments, the electric lamp comprises a first set of LEDs and a second set of LEDs; wherein the first set of LEDs is capable of emitting visible light at a first, fixed, light warmth value, which is the lower-bound value of said continuous spectrum of light warmth levels; wherein the second set of LEDs is capable of emitting visible light at a second, fixed, light warmth value, which is the upper-bound value of said continuous spectrum of light warmth levels.

In some embodiments, the electric lamp further comprises an electric circuit that is configured to blend (i) light emitted by the first set of LEDs with (ii) light emitted by the second set of LEDs.

In some embodiments, the electric circuit comprises a triac dimming unit that is configured to dim, separately, a positive half-wave and a negative half-wave of a sinus waveform of the Alternating Current (AC) that drives the first set of LEDs and the second set of LEDs.

In some embodiments, the electric circuit changes the Alternating Current (AC) into an electric current having a bi-phasic waveform; wherein the positive half of said bi-phasic waveform drives only the first set of LEDs via a first half-wave rectifier diode; wherein the negative half of said bi-phasic waveform drives only the second set of LEDs via a second half-wave rectifier diode.

In some embodiments, the electric circuit is configured to blend (i) light emitted by the first set of LEDs with (ii) light emitted by the second set of LEDs, without performing any temporary flickering or temporary blinking of any light.

In some embodiments, the electric circuit is configured to blend (i) light emitted by the first set of LEDs with (ii) light emitted by the second set of LEDs, without performing any temporary de-activation of the first set of LEDs when the second set of LEDs is illuminated, and without performing any temporary de-activation of the second set of LEDs when the first set of LEDs is illuminated.

In some embodiments, the electric circuit is configured to continuously provide electric power to the first set of LEDs and to the second set of LEDs; wherein at any time-point, both the first set of LEDs and the second set of LEDs continuously emit visible light.

In some embodiments, q indicates a phase angle between electric current and electric voltage; wherein the triac dimming unit of the electric circuit is configured to generate a positive phase angle $\varphi+$ and a negative phase angle $\varphi-$ that have different values.

In some embodiments, the triac dimming unit is configured to drive the first set of LEDs to emit visible light at a first brightness level Bw, wherein $Bw=(\varphi++\sin 2\varphi+)/\pi$, and wherein the triac dimming unit is configured to drive the second set of LEDs to emit visible light at a second brightness level Bc, wherein $Bc=(\varphi-+\sin 2\varphi-)/\pi$, and wherein an overall brightness level B of (i) light emitted by the first set of LEDs and (ii) light emitted by the second set of LEDs is: $B=2\ (Bw+Bc)$.

In some embodiments, the triac dimming unit is configured to generate a triac waveform having two degrees of freedom; wherein one of the two degrees of freedom of the generated triac waveform is an overall brightness level of blended light emitted by the first set of LEDs and the second set of LEDs; wherein another of the two degrees of freedom of the generated triac waveform is an overall temperature level of blended light emitted by the first set of LEDs and the second set of LEDs.

In some embodiments, the triac dimming unit is configured to enable continuous and non-discrete modification of the overall brightness level of the blended light to any value in a range of 0 to 100 percent brightness; wherein the triac dimming unit is configured to enable, continuous and non-discrete modification of the overall warmth level of the blended light to any value in a range of Tw and Tc, wherein Tw indicates warmth level of light emitted by the first set of LEDs when driven by non-dimmed AC power, wherein Tw indicates warmth level of light emitted by the first set of LEDs when driven by non-dimmed AC power.

In some embodiments, the triac dimming unit is configured to enable said continuous and non-discrete modification of the overall brightness level of the blended light, independently from and separately from said continuous and non-discrete modification of the overall warmth level of the blended light; wherein the triac dimming unit is configured to enable said continuous and non-discrete modification of the overall warmth level of the blended light, independently from and separately from said continuous and non-discrete modification of the overall brightness level of the blended light.

In some embodiments, the ceiling fan is operably associated with a processing unit and one or more sensors, which are configured to sense that a user is engaging in a particular activity; wherein the processing unit automatically configures said electric circuit, to cause the first set of LEDs and the second set of LEDs to emit visible light having a particular overall brightness level and a particular overall warmth level that are pre-defined as matching said particular activity.

In some embodiments, the ceiling fan is operably associated with a processing unit and one or more sensors, which are configured to sense that a user is engaging in a particular activity; wherein the processing unit automatically configures said electric circuit, to cause the first set of LEDs and the second set of LEDs to emit visible light having a particular overall brightness level and a particular overall warmth level that are pre-defined as matching said particular activity.

In some embodiments, the ceiling fan is operably associated with a processing unit running a Machine Learning (ML) algorithm, that autonomously determines that a particular user prefers a first particular overall brightness level and a first particular overall warmth level of the overall light at a first time-slot, and that autonomously determines that said particular user prefers a second, different, particular overall brightness level and a second, different, particular overall warmth level of the overall light at a second, different, time-slot, and that autonomously and automatically configures said electric circuit, to cause the first set of LEDs and the second set of LEDs to emit visible light having a particular overall brightness level and a particular overall warmth level based on whether a current time is within the first time-slot or the second time-slot.

In some embodiments, the ceiling fan is operably associated with a wireless remote control unit, that enables a user to configure an overall warmth level of overall emitted light to any value in a range of 3,000 K to 9.000 K. and that also enables the user to configure, separately and independently, an overall brightness level of overall emitted light to any value in a range of 0% to 100%.

In some embodiments, the first set of LEDs consists of a plurality of LEDs that are identical to each other; wherein the second set of LEDs consists of a plurality of LEDs that are identical to each other; wherein a LED of the first set of LEDs, has electrical properties that are non-identical to electrical properties of a LED of the second set of LEDs.

In some embodiments, the first set of LEDs consists of a plurality of LEDs that are identical to each other, wherein the second set of LEDs consists of a plurality of LEDs that are identical to each other; wherein a LED of the first set of LEDs, has electrical properties that are non-identical to electrical properties of a LED of the second set of LEDs; wherein LEDs of the first set of LEDs, and LEDs of the second set of LEDs, are arranged in a co-located structured, wherein each LED of the first set of LEDs is adjacent to at least one LED of the second set of LEDs. and wherein each LED of the second set of LEDs is adjacent to at least one LED of the second set of LEDs, to improve overall blending of emitted light.

In some embodiments, the ceiling fan further comprises: a wireless communication transceiver, configured to receive an incoming wireless communication signal that is wirelessly transmitted to the ceiling fan, wherein said incoming wireless communication signa indicates a user command to set an overall warmth level of overall emitted light to a particular warmth value.

Some embodiments comprise a non-transitory storage medium having stored thereon instructions that, when executed by one or more hardware processors, cause the one or more hardware processors to perform a method as described above.

In accordance with some embodiments, calculations, operations and/or determinations may be performed locally within a single device, or may be performed by or across multiple devices, or may be performed partially locally and partially remotely (e.g., at a remote server) by optionally utilizing a communication channel to exchange raw data and/or processed data and/or processing results.

Although portions of the discussion herein relate, for demonstrative purposes, to wired links and/or wired communications, some embodiments are not limited in this regard, but rather, may utilize wired communication and/or wireless communication; may include one or more wired and/or wireless links; may utilize one or more components of wired communication and/or wireless communication; and/or may utilize one or more methods or protocols or standards of wireless communication.

Some embodiments may be implemented by using a special-purpose machine or a specific-purpose device that is not a generic computer, or by using a non-generic computer or a non-general computer or machine. Such system or device may utilize or may comprise one or more components or units or modules that are not part of a "generic computer" and that are not part of a "general purpose computer", for example, cellular transceivers, cellular transmitter, cellular receiver, GPS unit, location-determining unit, accelerometer(s), gyroscope(s), device-orientation detectors or sensors, device-positioning detectors or sensors, or the like.

Some embodiments may be implemented as, or by utilizing, an automated method or automated process, or a machine-implemented method or process, or as a semi-automated or partially-automated method or process, or as a set of steps or operations which may be executed or performed by a computer or machine or system or other device.

Some embodiments may be implemented by using code or program code or machine-readable instructions or machine-readable code, which may be stored on a non-transitory storage medium or non-transitory storage article (e.g., a CD-ROM, a DVD-ROM, a physical memory unit, a physical storage unit), such that the program or code or instructions, when executed by a processor or a machine or a computer, cause such processor or machine or computer to perform a method or process as described herein. Such code or instructions may be or may comprise, for example, one or more of: software, a software module, an application, a program, a subroutine, instructions, an instruction set, computing code, words, values, symbols, strings, variables, source code, compiled code, interpreted code, executable code, static code, dynamic code; including (but not limited to) code or instructions in high-level programming language, low-level programming language, object-oriented programming language, visual programming language, compiled programming language, interpreted programming language, C. C++. C#, Java, JavaScript. SQL. Ruby on Rails, Go, Cobol. Fortran, ActionScript, AJAX. XML, JSON, Lisp. Eiffel, Verilog, Hardware Description Language (HDL), BASIC, Visual BASIC, MATLAB, Pascal, HTML, HTML5, CSS, Perl, Python. PHP, machine language, machine code, assembly language, or the like.

Discussions herein utilizing terms such as, for example, "processing", "computing", "calculating", "determining", "establishing", "analyzing", "checking", "detecting", "measuring", or the like, may refer to operation(s) and/or process(es) of a processor, a computer, a computing platform, a computing system, or other electronic device or computing device, that may automatically and/or autonomously manipulate and/or transform data represented as physical (e.g., electronic) quantities within registers and/or accumulators and/or memory units and/or storage units into other data or that may perform other suitable operations.

Some embodiments may perform steps or operations such as, for example, "determining", "identifying", "comparing", "checking", "querying", "searching", "matching", and/or "analyzing", by utilizing, for example: a pre-defined threshold value to which one or more parameter values may be compared; a comparison between (i) sensed or measured or calculated value(s), and (ii) pre-defined or dynamically-generated threshold value(s) and/or range values and/or upper limit value and/or lower limit value and/or maximum value and/or minimum value; a comparison or matching between sensed or measured or calculated data, and one or more values as stored in a look-up table or a legend table or a legend list or a database of possible values or ranges; a comparison or matching or searching process which searches for matches and/or identical results and/or similar results among multiple values or limits that are stored in a database or look up table; utilization of one or more equations, formula, weighted formula, and/or other calculation in order to determine similarity or a match between or among parameters or values; utilization of comparator units, lookup tables, threshold values, conditions, conditioning logic, Boolean operator(s) and/or other suitable components and/or operations.

The terms "plurality" and "a plurality", as used herein, include, for example, "multiple" or "two or more". For example, "a plurality of items" includes two or more items.

References to "one embodiment", "an embodiment". "demonstrative embodiment", "various embodiments", "some embodiments", and/or similar terms, may indicate that the embodiment(s) so described may optionally include a particular feature, structure, or characteristic, but not every embodiment necessarily includes the particular feature, structure, or characteristic. Furthermore, repeated use of the phrase "in one embodiment" does not necessarily refer to the same embodiment, although it may. Similarly, repeated use of the phrase "in some embodiments" does not necessarily refer to the same set or group of embodiments, although it may.

As used herein, and unless otherwise specified, the utilization of ordinal adjectives such as "first". "second". "third", "fourth", and so forth, to describe an item or an object, merely indicates that different instances of such like items or objects are being referred to; and does not intend to imply as if the items or objects so described must be in a particular given sequence, either temporally, spatially, in ranking, or in any other ordering manner.

Some embodiments may be used in, or in conjunction with, various devices and systems, for example, a Personal Computer (PC), a desktop computer, a mobile computer, a laptop computer, a notebook computer, a tablet computer, a server computer, a handheld computer, a handheld device, a Personal Digital Assistant (PDA) device, a handheld PDA device, a tablet, an on-board device, an off-board device, a hybrid device, a vehicular device, a non-vehicular device, a mobile or portable device, a consumer device, a non-mobile or non-portable device, an appliance, a wireless communication station, a wireless communication device, a wireless Access Point (AP), a wired or wireless router or gateway or switch or hub, a wired or wireless modem, a video device, an audio device, an audio-video (A/V) device, a wired or wireless network, a wireless area network, a Wireless Video Area Network (WVAN), a Local Area Network (LAN), a Wireless LAN (WLAN), a Personal Area Network (PAN), a Wireless PAN (WPAN), or the like.

Some embodiments may be used in conjunction with one way and/or two-way radio communication systems, cellular radio-telephone communication systems, a mobile phone, a cellular telephone, a wireless telephone, a Personal Communication Systems (PCS) device, a PDA or handheld device which incorporates wireless communication capabilities, a mobile or portable Global Positioning System (GPS) device, a device which incorporates a GPS receiver or transceiver or chip, a device which incorporates an RFID element or chip, a Multiple Input Multiple Output (MIMO) transceiver or device, a Single Input Multiple Output (SIMO) transceiver or device, a Multiple Input Single Output (MISO) transceiver or device, a device having one or more internal antennas and/or external antennas, Digital Video Broadcast (DVB) devices or systems, multi-standard radio devices or systems, a wired or wireless handheld device, e.g., a Smartphone, a Wireless Application Protocol (WAP) device, or the like.

Some embodiments may comprise, or may be implemented by using, an "app" or application which may be downloaded or obtained from an "app store" or "applications store", for free or for a fee, or which may be pre-installed on a computing device or electronic device, or which may be otherwise transported to and/or installed on such computing device or electronic device.

Functions, operations, components and/or features described herein with reference to one or more embodiments, may be combined with, or may be utilized in combination with, one or more other functions, operations, components and/or features described herein with reference to one or more other embodiments. Some embodiments may thus comprise any possible or suitable combinations, re-arrangements, assembly, re-assembly, or other utilization of some or all of the modules or functions or components that are described herein, even if they are discussed in different locations or different chapters of the above discussion, or even if they are shown across different drawings or multiple drawings.

While certain features of some demonstrative embodiments have been illustrated and described herein, various modifications, substitutions, changes, and equivalents may occur to those skilled in the art. Accordingly, the claims are intended to cover all such modifications, substitutions, changes, and equivalents.

What is claimed is:

1. A ceiling fan, comprising:

an electric motor, configured to rotate a set of blades;

an electric lamp, which is an integrated component of the ceiling fan and is co-located beneath said set of blades;

wherein the electric motor and the electric lamp receive electric power from a mains electric socket via a single electric power cord that provides Alternating Current (AC) power to both the electric motor and the electric lamp;

wherein the electric lamp is configured to emit visible light having light warmth at a user-configurable level along a continuous spectrum of light warmth;

wherein the continuous spectrum of light warmth, that can be is emitted by said electric lamp, is a continuous spectrum between a lower-bound value and an upper-bound value;

wherein the electric lamp comprises a first set of LEDs and a second set of LEDs;

wherein the first set of LEDs emits visible light at a first, fixed, light warmth value, which is the lower-bound value of said continuous spectrum of light warmth levels;

wherein the second set of LEDs emits visible light at a second, fixed, light warmth value, which is the upper-bound value of said continuous spectrum of light warmth levels;

wherein the electric lamp further comprises an electric circuit that is configured to blend (i) light emitted by the first set of LEDs with (ii) light emitted by the second set of LEDs;

wherein the electric circuit comprises a triac dimming unit that is configured to dim, separately, a positive half-wave and a negative half-wave of a sinus waveform of the Alternating Current (AC) that drives the first set of LEDs and the second set of LEDs;

wherein the electric circuit changes the Alternating Current (AC) into an electric current having a bi-phasic waveform;

wherein the positive half of said bi-phasic waveform drives only the first set of LEDs via a first half-wave rectifier diode;

wherein the negative half of said bi-phasic waveform drives only the second set of LEDs via a second half-wave rectifier diode.

2. The ceiling fan of claim 1, wherein the ceiling fan is operably associated with a wireless remote control unit, that enables a user to configure an overall warmth level of overall emitted light to any value in a range of 3,000 K to 9,000 K, and that also enables the user to configure, separately and independently, an overall brightness level of overall emitted light to any value in a range of 0% to 100%.

3. The ceiling fan of claim 1, wherein the first set of LEDs consists of a plurality of LEDs that are identical to each other;

wherein the second set of LEDs consists of a plurality of LEDs that are identical to each other;

wherein a LED of the first set of LEDs, has electrical properties that are non-identical to electrical properties of a LED of the second set of LEDs.

4. The ceiling fan of claim 1, wherein the first set of LEDs consists of a plurality of LEDs that are identical to each other;

wherein the second set of LEDs consists of a plurality of LEDs that are identical to each other;

wherein a LED of the first set of LEDs, has electrical properties that are non-identical to electrical properties of a LED of the second set of LEDs;

wherein LEDs of the first set of LEDs, and LEDs of the second set of LEDs, are arranged in a co-located structured, wherein each LED of the first set of LEDs is adjacent to at least one LED of the second set of LEDs, and wherein each LED of the second set of LEDs is adjacent to at least one LED of the second set of LEDs, to improve overall blending of emitted light.

5. The ceiling fan of claim 1, further comprising:

a wireless communication transceiver, configured to receive an incoming wireless communication signal that is wirelessly transmitted to the ceiling fan, wherein said incoming wireless communication signa indicates a user command to set an overall warmth level of overall emitted light to a particular warmth value.

6. The ceiling fan of claim 1, wherein the electric circuit is configured to blend (i) light emitted by the first set of LEDs with (ii) light emitted by the second set of LEDs, without performing any temporary flickering or temporary blinking of any light.

7. The ceiling fan of claim 6, wherein the electric circuit is configured to blend (i) light emitted by the first set of LEDs with (ii) light emitted by the second set of LEDs, without performing any temporary de-activation of the first set of LEDs when the second set of LEDs is illuminated, and without performing any temporary de-activation of the second set of LEDs when the first set of LEDs is illuminated.

8. The ceiling fan of claim 7, wherein the electric circuit is configured to continuously provide electric power to the first set of LEDs and to the second set of LEDs;

wherein at any time-point, both the first set of LEDs and the second set of LEDs continuously emit visible light.

9. The ceiling fan of claim 1, wherein $\varphi$ indicates a phase angle between electric current and electric voltage;

wherein the triac dimming unit of the electric circuit is configured to generate a positive phase angle $\varphi+$ and a negative phase angle $\varphi-$ that have different values.

10. The ceiling fan of claim 9, wherein the triac dimming unit is configured to drive the first set of LEDs to emit visible light at a first brightness level Bw, wherein $$Bw=(\varphi++\sin 2\varphi+)/\pi$$

wherein the triac dimming unit is configured to drive the second set of LEDs to emit visible light at a second brightness level Bc, wherein $$Bc=(\varphi-+\sin 2\varphi-)/\pi$$

and wherein an overall brightness level B of (i) light emitted by the first set of LEDs and (ii) light emitted by the second set of LEDs is $$B=2(Bw+Bc).$$

11. The ceiling fan of claim 10, wherein the triac dimming unit is configured to generate a triac waveform having two degrees of freedom, wherein one of the two degrees of freedom of the generated triac waveform is an overall brightness level of blended light emitted by the first set of LEDs and the second set of LEDs, wherein another of the two degrees of freedom of the generated triac waveform is an overall temperature level of blended light emitted by the first set of LEDs and the second set of LEDs.

12. The ceiling fan of claim 11, wherein the triac dimming unit is configured to enable continuous and non-discrete modification of the overall brightness level of the blended light to any value in a range of 0 to 100 percent brightness;

wherein the triac dimming unit is configured to enable, continuous and non-discrete modification of the overall warmth level of the blended light to any value in a range of Tw and Tc, wherein Tw indicates warmth level of light emitted by the first set of LEDs when driven by non-dimmed AC power, wherein Tw indicates warmth level of light emitted by the first set of LEDs when driven by non-dimmed AC power.

13. The ceiling fan of claim 12, wherein the triac dimming unit is configured to enable said continuous and non-discrete modification of the overall brightness level of the blended light, independently from and separately from said continuous and non-discrete modification of the overall warmth level of the blended light;

wherein the triac dimming unit is configured to enable said continuous and non-discrete modification of the overall warmth level of the blended light, independently from and separately from said continuous and non-discrete modification of the overall brightness level of the blended light.

14. The ceiling fan of claim 1, wherein the ceiling fan is operably associated with a processing unit and one or more sensors, which are configured to sense that a user is engaging in a particular activity;

wherein the processing unit automatically configures said electric circuit, to cause the first set of LEDs and the second set of LEDs to emit visible light having a particular overall brightness level and a particular overall warmth level that are pre-defined as matching said particular activity.

15. The ceiling fan of claim 1, wherein the ceiling fan is operably associated with a processing unit and one or more sensors, which are configured to sense that a user is engaging in a particular activity;

wherein the processing unit automatically configures said electric circuit, to cause the first set of LEDs and the second set of LEDs to emit visible light having a particular overall brightness level and a particular overall warmth level that are pre-defined as matching said particular activity.

16. The ceiling fan of claim 1, wherein the ceiling fan is operably associated with a processing unit running a Machine Learning (ML) algorithm, that autonomously determines that a particular user prefers a first particular overall brightness level and a first particular overall warmth level of the overall light at a first time-slot, and that autonomously determines that said particular user prefers a second, different, particular overall brightness level and a second, different, particular overall warmth level of the overall light at a second, different, time-slot, and that autonomously and automatically configures said electric circuit, to cause the first set of LEDs and the second set of LEDs to emit visible light having a particular overall brightness level and a particular overall warmth level based on whether a current time is within the first time-slot or the second time-slot.

* * * * *